US007504348B1

(12) United States Patent
Hagewood et al.

(10) Patent No.: US 7,504,348 B1
(45) Date of Patent: Mar. 17, 2009

(54) PRODUCTION OF NONWOVEN FIBROUS WEBS INCLUDING FIBERS WITH VARYING DEGREES OF SHRINKAGE

(75) Inventors: John Hagewood, West Melbourne, FL (US); Arthur Talley, Jr., Melbourne, FL (US); Arnold E. Wilkie, Merrit Island, FL (US)

(73) Assignee: Hills, Inc., West Melbourne, FL (US)

( * ) Notice: Subject to any disclaimer, the term of this patent is extended or adjusted under 35 U.S.C. 154(b) by 0 days.

(21) Appl. No.: 10/214,458

(22) Filed: Aug. 8, 2002

Related U.S. Application Data

(60) Provisional application No. 60/312,764, filed on Aug. 17, 2001.

(51) Int. Cl.
*D04H 1/00* (2006.01)
*D04H 13/00* (2006.01)
*D04H 5/00* (2006.01)

(52) U.S. Cl. ..... 442/401; 442/352

(58) Field of Classification Search ..... 442/341, 442/352, 353, 356, 358, 401–414, 415, 382, 442/392; 428/180
See application file for complete search history.

(56) References Cited

U.S. PATENT DOCUMENTS 3,917,448 A * 11/1975 Wood ..... 8/125
3,959,569 A * 5/1976 Burkholder, Jr. ..... 428/479.6
5,002,815 A * 3/1991 Yamanaka et al. ..... 428/109
5,221,573 A * 6/1993 Baigas, Jr. ..... 428/212
5,366,792 A * 11/1994 Shirayanagi et al. ..... 428/196
5,525,706 A 6/1996 Gruber et al.
5,759,926 A 6/1998 Pike et al.
5,958,322 A 9/1999 Thompson et al.
6,146,580 A 11/2000 Bontaites, Jr.
6,371,749 B2 4/2002 Thompson et al.
6,613,704 B1 * 9/2003 Arnold et al. ..... 442/361
7,192,499 B1 * 3/2007 Talley, Jr. ..... 156/84

FOREIGN PATENT DOCUMENTS

JP 03-167341 * 11/1989

* cited by examiner

*Primary Examiner*—Norca L Torres-Velazquez
(74) *Attorney, Agent, or Firm*—Edell, Shapiro & Finnan, LLC

(57) ABSTRACT

Nonwoven fibrous webs are formed including a first group and a second group of fibers, where fibers of the first group are imparted with a degree of shrinkage that differs from a degree of shrinkage imparted to fibers in the second group. During or after bonding of the web, the web may be subjected to heat treatment causing fibers in one of the groups to shrink a greater amount in comparison to fibers in the other group, resulting in nonwoven products with desired textures and other physical characteristics.

8 Claims, 4 Drawing Sheets

PRODUCTION OF NONWOVEN FIBROUS WEBS INCLUDING FIBERS WITH VARYING DEGREES OF SHRINKAGE

CROSS REFERENCE TO RELATED APPLICATIONS

This application claims priority from U.S. Provisional Patent Application Ser. No. 60/312,764, entitled "Method For Producing Crystallized Polyester Spunbond Fabrics", filed Aug. 17, 2001. The disclosure of this provisional patent application is incorporated herein by reference in its entirety.

BACKGROUND OF THE INVENTION

1. Field of the Invention

The present invention relates to the production of nonwoven webs of fibers with varying degrees of shrinkage.

2. Description of the Related Art

One of the primary reasons that certain polymers such as polyester are not more widely used in spunbond fabrics is that, unless the spinning speed of the fibers is greater than about 3500 meters per minute (MPM), the fabric will shrink by 50% or more during "post-spun" heating processes. Typically, "post-spun" heating processes include, but are not limited to, processes involving fabric bonding with hot calender rolls or other heat bonding devices. Shrinkage of the fibers occurs because the fibers are not crystallized, but instead are relatively amorphous, when produced at these low spinning speeds. Upon heating, such fibers contract or shrink as crystals are formed in an unconstrained state in the fibers, becoming thermally stable only when heated to their full crystallization temperatures (e.g., above about 120° C. for polyester) for a sufficient period of time.

To rectify this problem, spun bond draw jets and spunbond processes have been developed to accelerate the fibers to speeds above 3500 MPM during spinning, causing the spun fibers to become relatively crystalline during fiber formation. However, many conventional spun bond machines do not utilize such draw jets and processing capabilities, as these draw jets and processes tend to be complex and expensive to implement and operate.

Other types of nonwoven fibrous web forming processes experience similar heat shrinkage problems with polyester or other related polymers that remain relatively amorphous after fiber extrusion. In particular, polymers such as polyethylene terephthalate (PET) remain relatively amorphous when extruded using a meltblown process. A meltblown process differs from a spunbond process in that extruded polymer filaments, upon emerging from an extruder die, are immediately blown with a high velocity, heated medium (e.g., air) onto a suitable support surface. In contrast, extruded but substantially solidified filaments (e.g., solidified by a suitable quenching medium such as air) in a spunbond process are drawn and attenuated utilizing a suitable drawing unit (e.g., an aspirator or godet rolls) prior to being laid down on a support surface. Meltblown processes are typically utilized in forming fibers having diameters on a micron level, whereas spunbond processes are typically employed to produce fibers having normal textile dimensions.

Many attempts have been made to achieve heat stable and shrinkage controlled nonwoven fibrous webs of polyester utilizing a meltblown process. For example, U.S. Pat. Nos. 5,958,322 and 6,371,749 to Thompson et al., which are incorporated herein by reference in their entireties, disclose an apparatus and corresponding methods for making dimensionally stable nonwoven fibrous webs of polyester utilizing a meltblown process. In particular, the Thompson et al. patents disclose melt blowing polyester fibers and restraining a nonwoven web of the fibers on a tentering structure. The restrained fibers are then annealed or heatset in an oven to render the nonwoven web dimensionally stable up to at least the heatsetting temperature of the fibers.

The apparatus and corresponding methods described in the Thompson et al. patents require an excessive amount of fiber material to be wound around the tentering pins of the tentering structure in order to achieve a suitable restraining of the fibers during heat treatment. Depending upon the type of nonwoven fabric to be manufactured, the tentering process of Thompson et al. may result in a considerable amount of unnecessary or even undesirable fiber material in the fabric. This process would also not easily lend itself to operation at high fabric speeds as often used, e.g., in spunbond processes.

In addition, it is anticipated that a variety of unique nonwoven web products could be achieved by allowing fibers in a nonwoven web to shrink at varying degrees with respect to each other during web formation. However, previous attempts at controlling shrinkage of polymer fibers, such as PET fibers, during web formation have been primarily focused on limiting or preventing any shrinkage of the fibers. Thus, there has been very little effort in the art to produce nonwoven web products where shrinkage of fibers is encouraged to produce a desired physical result for the web product.

Accordingly, a process for manufacturing a variety of nonwoven webs of fibers with differing physical characteristics is desirable where the webs include fibers with varying degrees of shrinkage.

SUMMARY OF THE INVENTION

Therefore, in light of the above, and for other reasons that become apparent when the invention is fully described, an object of the present invention is to produce nonwoven fibrous webs where at least some of the fibers exhibit shrinkage when subjected to heat.

It is another object of the present invention to produce such nonwoven fibrous utilizing a spunbond process.

It is a further object of the present invention to produce nonwoven fibrous webs having fibers with varying degrees of shrinkage so as to yield nonwoven web products with a variety of different physical characteristics.

It is still another object of the present invention to produce a nonwoven web product including a relatively smooth side and an opposing wrinkled or puckered side as a result of shrinking some fibers by a greater amount than other fibers within the web when exposed to heat.

The aforesaid objects are achieved individually and in combination, and it is not intended that the present invention be construed as requiring two or more of the objects to be combined unless expressly required by the claims attached hereto.

Nonwoven fibrous webs are produced in accordance with the present invention by forming a web of fibers including a first group of fibers and a second group of fibers on a web forming surface, treating the first and second group of fibers to achieve a difference in degree of shrinkage between fibers in the first and second groups, and bonding the web of fibers. A difference in degree of shrinkage between groups of fibers in the web may be achieved utilizing a single laydown system, or, alternatively, multiple laydown systems. In an exemplary embodiment, a difference in degree of shrinkage is achieved between groups of fibers formed in a single or multiple laydown process by varying the heat applied to two or more groups of fibers during bonding of the web while the fibers are held under tension or constraint so as to limit or prevent shrinkage of the fibers. In another exemplary embodiment, a difference in degree of shrinkage is achieved between groups of fibers in a multiple laydown process by varying processing parameters of different fiber groups prior to combining and bonding the fiber groups to form a multilayered web. Heat treatment of the bonded web causes shrinkage of at least one of the groups of fibers by a greater amount in comparison to at least one other group of fibers.

The above and still further objects, features and advantages of the present invention will become apparent upon consideration of the following detailed description of specific embodiments thereof.

DESCRIPTION OF THE PREFERRED EMBODIMENTS

Figure 1:
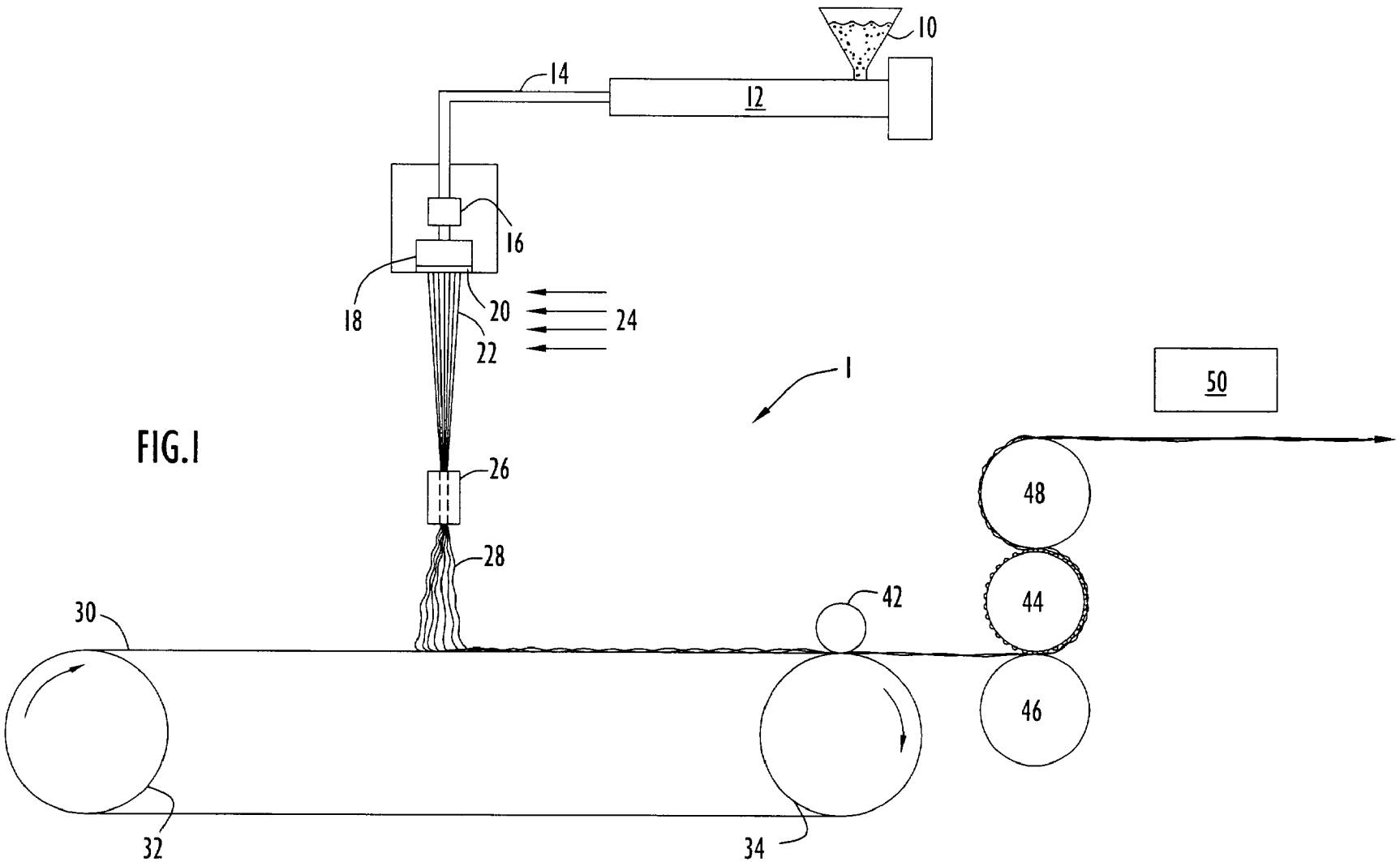
FIG. 1 is a diagrammatic view of a spunbond system for forming nonwoven webs of fibers in accordance with an exemplary embodiment of the present invention.

The present invention involves the production of nonwoven fibrous webs with groups of fibers having varying degrees of shrinkage, where each fiber group includes at least one fiber. The term "degree of shrinkage", as used herein, refers to a potential amount by which one or more fibers in a bonded web will shrink, upon being subjected to thermal bonding and/or post-bonding heat treatment and substantially absent any constraint, from initial longitudinal and/or transverse dimensions to final longitudinal and/or transverse dimensions. A variety of nonwoven web products with different physical characteristics can be achieved by varying the degree of shrinkage for groups of fibers in the bonded web. The degree of shrinkage is preferably varied between two or more groups of fibers in a web such that a first group of fibers is substantially shrink resistant and dimensionally stable up to a heat set temperature while a second group of fibers is susceptible to some amount of shrinkage during thermal bonding and/or post-bonding heat treatment of the web. In particular, nonwoven fabrics formed in accordance with the present invention include a wrinkled or puckered surface and a relatively smooth opposing surface as a result of the differences in shrinkage between groups of fibers in the fabric upon exposure to heat.

A variation in degree of shrinkage between groups of fibers within a nonwoven web can be achieved by processing the fibers to obtain a selected crystallinity differential between these fiber groups. The term "crystallinity differential", as used herein, refers to a difference in degree of crystallinity between two or more groups of fibers in the nonwoven web. A crystallinity differential and resultant difference in degree of shrinkage between groups of fibers can be achieved in a variety of ways in accordance with the present invention. For example, different polymer components may be utilized in different fiber groups to achieve a desired crystallinity differential during fiber and/or web formation. Alternatively, the same polymer components may be utilized in different groups, but each of these fiber groups may be subjected to different processing parameters in order to achieve a desired crystallinity differential. In addition, a desired crystallinity differential between two or more groups of fibers may be achieved at any point or points prior to, during and/or after bonding of the nonwoven web. Furthermore, the web may be formed, bonded and heat set in a single, inline process or, alternatively, in separate and independent processes, to achieve selected shrinkage levels between groups of fibers and a resultant nonwoven web product.

Alternatively, a variation in degree of shrinkage between different fiber groups can be obtained by utilizing different polymer components in one or more groups that have inherently different shrinkages when subjected to heat, regardless of whether or not they have a crystallinity differential. For example, a co-polyester group of fibers will normally have a greater degree of shrinkage, and thus will shrink by a larger amount when exposed to heat, than a comparably processed group of polyester fibers. In a further example, a polyamide group of fibers will have a degree of shrinkage that differs from a polyester group of fibers, where the polyamide group may shrink more or less than the polyester group when exposed to heat depending upon selected spinning speeds for both groups.

Any suitable polymer or combination of polymers may be utilized to obtain a nonwoven web with groups of fibers having varying degrees of shrinkage. Exemplary polymers include, without limitation, polyesters such as polyethylene terephthalate (PET), polyethylene naphthalate (PEN), polytrimethylene terephthalate (PTT) and polybutylene terephthalate (PBT); polyurethanes; polycarbonates; polylactic acid (PLA); polyamides such as Nylon 6, Nylon 6,6 and Nylon 6,10; polyolefins such as polyethylene and polypropylene; ethylene vinyl alcohol (EVOH); and polyvinyl alcohol (PVA); and any combinations thereof (e.g., slow crystallizing copolyesters of PET based on comonomers such as isophthalic acid and cyclohexane dimethanol). In addition, groups of extruded fibers which form the nonwoven web may include single polymer component fibers and/or multicomponent (e.g., bicomponent) fibers, with multicomponent fibers including any suitable transverse cross-sectional geometry (e.g., side-by-side, sheath/core, trilobal, segmented pie, islands-in-the-sea, etc.). For example, different polymer components could be utilized in a group of multicomponent fibers, such as side-by-side fibers, to achieve a desired level of crimp in the fibers and a resultant contraction or shrinkage of the fiber group in relation to other fiber groups in the web when subjected to heat so as to effect desired characteristics in the resultant woven web.

In manufacturing the nonwoven webs, fibers are initially extruded from one or more molten polymer sources utilizing a spunbond, meltblown or any other suitable fiber extrusion process. The extruded fibers are laid down on a web forming surface so as to form a web. As used herein, the term "web forming surface" refers to any surface that receives and supports extruded fibers to form the web. Examples of a suitable web forming surface include, without limitation, a table, a screen belt, a roll or any other suitable collector. Web formation may be achieved utilizing a single laydown or multiple laydowns of fibers. The web is bonded, either inline with the extrusion and laydown process or in another process, utilizing a bonder. The term "bonder", as used herein, refers to any suitable device that effects a desired degree of bonding of fibers in the web. A combination of heat and pressure may be applied to the web to (e.g., utilizing calender rolls) to crystallize a selected group of fibers in the web while the web is bonded. Alternatively, the web may be bonded utilizing minimal or no heat (e.g., utilizing a needling or hydro-entangling process) to ensure relatively little or no crystallization of fibers occurs during the bonding process. A nonwoven web product with desired physical characteristics is produced upon applying an appropriate heat treatment to the bonded web to achieve the varying amounts of shrinkage between groups of fibers in the web.

An exemplary system for manufacturing a nonwoven fibrous web with groups of fibers having varying degrees of shrinkage is illustrated in FIG. 1. While the process depicted in FIG. 1 is a spunbond process, it is noted that nonwoven webs of fibers may alternatively be formed utilizing a melt blown or any other suitable fiber formation process. In this process, a difference in degree of shrinkage between groups of fibers in the web is achieved upon bonding of the web as described below.

Spunbond system 1 includes a hopper 10 into which pellets of polymer are placed. The polymer is fed from hopper 10 to screw extruder 12, where the polymer is melted. The molten polymer flows through heated pipe 14 into metering pump 16 and spin pack 18. Spin pack 18 includes a spinneret 20 with orifices through which fibers 22 are extruded. Although the system of FIG. 1 depicts a single polymer component fiber formation system, it is noted that the spin pack design may be configured to accommodate multiple molten polymer flows for producing groups of different single component polymer fibers or multiple component polymer fibers with any of the previously noted fiber cross-sectional geometries. An exemplary embodiment of a suitable spin pack that may be utilized with the system is described in U.S. Pat. No. 5,162,074, the disclosure of which is incorporated herein by reference in its entirety.

The extruded fibers 22 are quenched with a suitable quenching medium 24 (e.g., air), and are subsequently directed into a drawing unit 26, depicted as an aspirator in FIG. 1, to increase the fiber velocity and to attenuate the fibers. Alternatively, it is noted that godet rolls or any other suitable drawing unit may be utilized to attenuate the fibers. The spinning speed of the extruded fibers may be adjusted by controlling operating parameters of the metering pump, the drawing unit and flow of polymer fluid through the spin pack. Thus, a suitable spinning speed (e.g., a speed of less than about 3500 MPM) may be easily maintained during system operation so as to ensure that the fibers are relatively amorphous or have a desired degree of crystallinity upon being laid down to form a web. Additionally, the degree of crystallinity of the fibers may also be controlled by other processing parameters, such as quenching medium temperature and velocity. Controlling the degree of crystallinity of the fibers in turn controls the degree of shrinkage of the groups of fibers in the bonded web and thus the amount by which fibers in each group shrink upon being subjected to post-bonding heat treatment.

Upon exiting the drawing unit 26, the attenuated fibers 28 are laid down upon a web forming surface, depicted in FIG. 1 as a continuous rotating screen belt 30. The screen belt 30 is driven by rolls 32 and 34 and conveys the web of fibers past a compaction roll 42 to a nip formed by heated calender rolls 44 and 46 that are vertically aligned in a stacked relationship with each other. However, the calender rolls may be aligned with each other in a horizontal or any other suitable relationship, depending upon the alignment of the calender rolls with the web forming surface. The calender rolls 44 and 46 bond the fibers in a selected pattern. While upper calender roll 44 is depicted as including a patterned texture on its outer surface to effect suitable bonding of the web, it is noted that either or both of the upper and lower calender rolls may include one or more suitable patterned textures.

The heated calender rolls 44 and 46 are set at different temperatures so as to heat the web of fibers to different temperatures, resulting in a selected degree of crystallization and a resultant difference in degree of shrinkage for groups of fibers in the web. For example, when manufacturing a web of single component PET fibers, upper calender roll 44 may be heated to a greater temperature than lower calender roll 46 to effect substantial crystallization of PET fibers in a first group that forms the upper layer of the web and is in direct contact with roll 44, while PET fibers in a second group that forms an opposing second layer of the web and is in direct contact with roll 46 remain relatively amorphous or are crystallized to a lesser degree than fibers in the first group. The selection of a specific temperature differential between calender rolls 44 and 46 will depend upon a number of factors including, without limitation, the types of polymer components that make up the fibers in the groups, the thickness of the nonwoven web, the web processing speed, and the desired degree of shrinkage for each group of fibers in the web. In the example of forming a web of single component PET fibers, the temperature of upper roll 44 may be set to about 180° C. to achieve a web temperature of at least about 120° C. (i.e., the temperature at which PET is capable of becoming fully crystalline), whereas the lower roll 46 may be set at a temperature of about 110° C. The lower roll temperature range is selected to render suitable bond points between fibers while substantially limiting or preventing crystallization of the group of fibers contacting the lower roll. Thus, a desired degree of crystallinity may be achieved for each of the first and second fiber groups in the bonded web once the web has emerged from the calender rolls.

Heated fibers that have crystallized during bonding at the calender rolls are prevented from shrinking in system 1 by a constraining member that effects constraint of the fibers during and immediately after they are heat bonded. The constraining member utilized in system 1 is a tension roll 48 disposed at a selected location directly above upper calendar roll 44. The tension roll may be maintained at any suitable temperature (e.g., ambient) and may be of any suitable type (e.g., a calender roll, an idler roll, etc.). It is further noted that any suitable constraining mechanism may be utilized in combination with the calender rolls to effect a desired degree of constraint and thus limit or prevent shrinkage of the bonded fibers emerging from the calender rolls. The tension roll 48 may be in direct contact with upper roll 44 or, alternatively, positioned a selected distance from the upper roll. The tension roll may be driven if in direct contact with the upper roll. Alternatively, the speed of the tension roll may be independently controlled to selectively vary the degree of constraint on the fibers. In addition, it is noted that the tension roll may be disposed at a selected distance beneath the lower calender roll, instead of above the upper calender roll, to effect a desired degree of constraint upon the bonded fibers emerging from the nip of the calender rolls.

Bonded fibers emerging from the nip of the calender rolls in system 1 are directed around upper roll 44 and separate from the upper roll at about a twelve o'clock position of the roll. Upon separating from the upper calender roll, the fibers are directed around a portion of tension roll 48. A suitable tension is applied to the bonded fibers by the combination of the upper calender and tension rolls from the point at which the fibers exit the nip between the calender rolls and at least a point at which the fibers separate from the upper calender roll and/or are transferred to the tension roll. This application of tension to the bonded fibers substantially limits or prevents shrinkage of fibers that are crystallizing as a result of being heat bonded by the calender rolls. The residence time of the fibers on the upper calender and tension rolls is preferably selected to ensure that, upon emerging from the tension roll and release of applied tension on the fibers, heated fibers in the bonded web have achieved a desired degree of crystallinity so that the bonded web remains relatively dimensionally stable prior to being subjected to post-bonding heat treatment. Upon separating from the tension roll, the fiber groups have achieved a difference in degree of shrinkage. Referring to the PET single component fiber example, the first fiber group will have achieved a desired degree of crystallization while the second fiber group will remain relatively amorphous or crystallize to a substantially lesser degree in comparison to the first group. Furthermore, since both fiber groups have undergone little or no shrinkage due to the constraint applied by the tension roll, the opposing surfaces of the bonded web are substantially similar in texture and physical appearance.

The bonded web is subjected to heat by a heat source 50 disposed downstream at a suitable location from the tension roll. The web of fibers is heated by heat source 50 to a sufficient temperature and for a sufficient period of time to heat set the web and achieve a desired degree of crystallinity for the second fiber group. Exemplary heat sources that may be utilized to heat the web of fibers in system 1 include, without limitation, ovens, hot air knives, steam or other heated gases, heated water (or other heated fluid mediums) and radiation (e.g., X-ray or infrared). As the web is heated by heat source 50, the second group of crystallizing fibers shrinks in relation to the first group of fibers, which experiences little or no shrinkage as a result of being previously crystallized and heat set while constrained at the calendar roll/tension roll location in system 1. After heat treatment by heat source 50, the bonded and heat set web of fibers may be subjected to further inline processing and/or rolled onto a winder for further processing by other systems.

The difference in amount of shrinkage of the second fiber group in relation to the first fiber group due to the heat treatment by heat source 50 results in a corresponding difference in texture, drape and feel between the opposing surfaces of the nonwoven web. In particular, the first fiber group, which undergoes little or no shrinkage during this heat setting treatment, includes fiber portions that extend out and away from the web as a result of shrinkage of fibers in the second group to which the first group fibers are bonded. The end result is a nonwoven product with a bulky or puffy surface on one side formed by extending portions of first group fibers and an opposing, relatively smooth side formed by second group fibers.

While the upper calender roll in system 1 is set to a higher temperature than the lower calender roll as described above, it is noted that either of the calender rolls may be set to the higher temperature to achieve the desired difference in degree of shrinkage between two or more groups of fibers in the web. In systems similar to the embodiment of FIG. 1, it may be desirable in certain situations (e.g., depending upon line speed, web weight and thickness, polymer components utilized to form the web, etc.) to set the upper calender roll with the higher temperature, as the residence time of the bonded fibers is greater on the upper calender roll in comparison to the lower calender roll. In other situations, it may be desirable to set the lower calendar roll at the higher temperature to minimize the residence time at which the fibers are heated.

In certain situations, it may be desirable to maintain the degree of shrinkage in the bonded web so that the second group of fibers may be shrunk in other processing systems. In these situations, heat source 50 of the system of FIG. 1 may be removed and the bonded web wound directly onto a roll after separating from the tension roll 48. The bonded web may then be transported to other systems for additional processing involving heat treatment of the web to achieve a desired shrinkage of the second fiber group in relation to the first fiber group and resultant physical features of the web.

The system of FIG. 1 may be modified by removal of the tension roll and providing an appropriate constraining member at a location proximate the heat source, where the constraining member would limit or substantially prevent fiber shrinkage during post-bonding heat treatment of the web. In such a modification, the first group of crystallizing fibers would shrink relative to the second group of relatively amorphous fibers during bonding of the web. However, post-bonding heat treatment combined with appropriate constraint would limit or prevent shrinkage of the second group of fibers, thus rendering a heat set nonwoven web product that is similar to the product described above, with the bulky or puffy side of the product being formed by the second group of fibers rather than the first group.

It is further noted that, while the system described above and illustrated in FIG. 1 is capable of producing nonwoven webs including at least two groups of fibers with varying degrees of shrinkage, this system is also capable of producing nonwoven webs of fibers where the fibers all have the same or substantially similar degrees of shrinkage. For example, the calender rolls 44 and 46 may be heated to similar temperatures such that all the fibers in the web are sufficiently crystallized upon being bonded to impart a substantially similar degree of shrinkage for each of the fibers, where shrinkage of these fibers is substantially prevented or limited due to the constraint applied to the fibers by the tension roll 48, or other suitable constraining member. Thus, the system of FIG. 1 eliminates the previously noted problem associated with producing spunbond webs of polyester fibers, or other polymer fibers exhibiting similar physical properties after extrusion, at low spinning speeds (e.g., below 3500 MPM) while minimizing or substantially eliminating post-calender shrinkage of the web.

Figure 2:
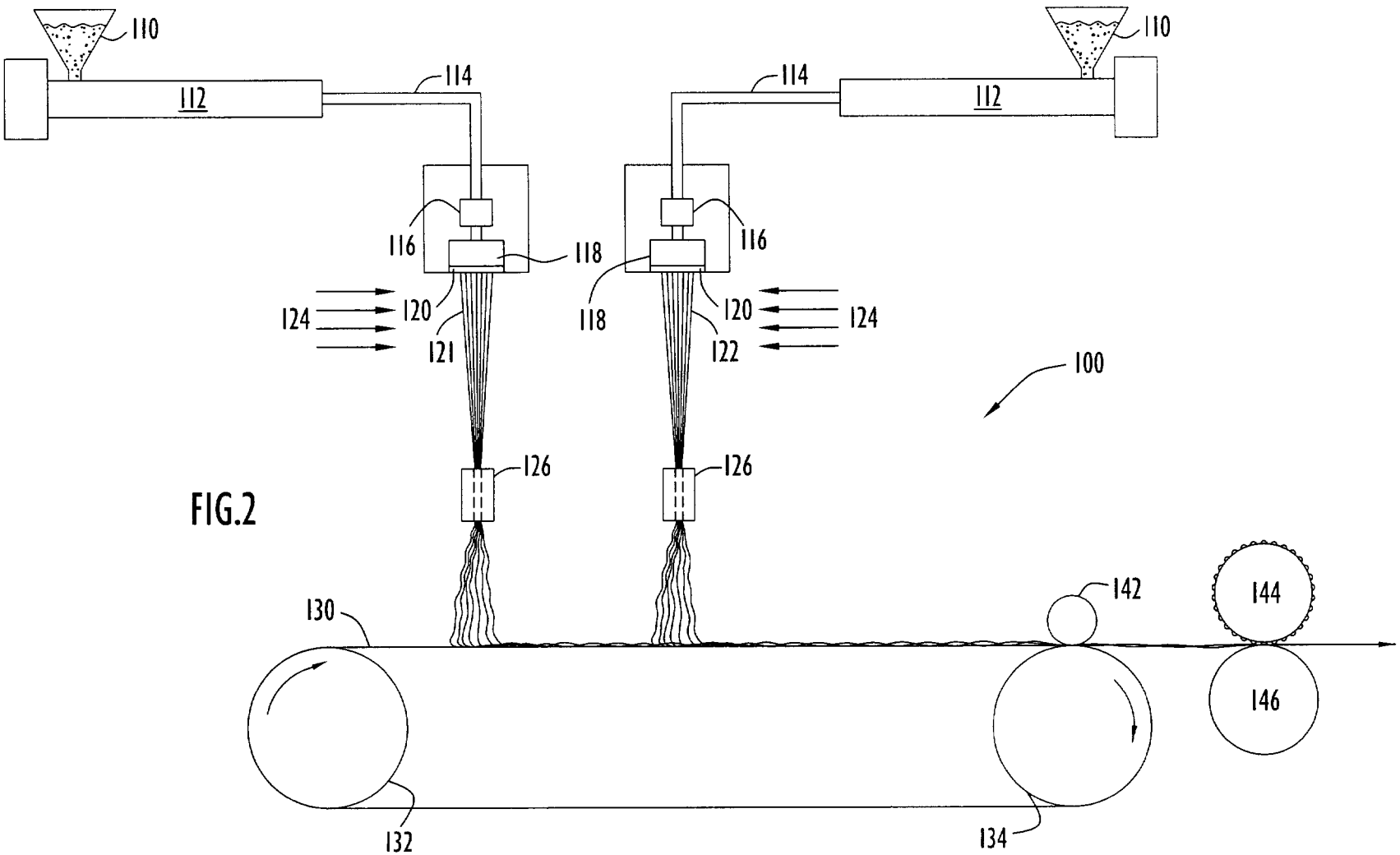
FIG. 2 is a diagrammatic view of a spunbond system for forming nonwoven webs of fibers in accordance with another exemplary embodiment of the present invention.

In another embodiment of the invention, a multiple laydown system is employed to obtain a bonded web including groups of fibers with varying degrees of shrinkage. In contrast to the previous system illustrated in FIG. 1, the varying degree of shrinkage between groups of fibers is achieved in this system prior to bonding of the web. Each laydown of polymer fibers onto the web forming surface occurs in a substantially similar manner as the system described above and illustrated in FIG. 1. Referring to FIG. 2, system 100 depicts a dual fiber laydown process and includes a pair of hoppers 110. Each hopper 110 delivers polymer to a screw extruder 112 and into a heated pipe 114. Molten polymer from each heated pipe 114 is delivered to a metering pump 116 and into a corresponding spin pack 118. Two groups of polymer fibers 121 and 122 are extruded through corresponding spinnerets 120 and are quenched by a quenching medium 124. Each group of quenched fibers 121, 122 is then attenuated by a corresponding drawing unit 126 and laid down upon a continuous rotating screen belt 130. The screen belt is driven by a pair of rolls 132 and 134. System 100 is further configured such that fibers 121 are laid down as a first group on belt 130 upstream of fibers 122, which are laid down as a second group on top of the first group to form a multilayered web.

A varying degree of shrinkage may be achieved between the two groups of fibers 121 and 122 in system 100 in a variety of different ways. Preferably, a suitable degree of shrinkage is achieved for fibers in each group prior to combining the fiber groups together to form the multilayered web. While some examples for achieving a varying degree of shrinkage between groups of fibers in a multiple laydown system are described below, it is noted that the present invention is no way limited to these examples, and any other suitable method or methods for achieving such a desired difference in degree of shrinkage may be employed alone or in combination with these examples.

In one embodiment, different polymer components are used to form fibers in different groups, where the differing polymer components achieve significantly different degrees of shrinkage during fiber formation. For example, the first group may include PET fibers, whereas the second group includes polyethylene and/or PBT fibers. Both fiber groups may be formed at spinning speeds below about 3500 MPM to yield a desired degree of crystallinity and resultant difference in degree of shrinkage for the first and second fiber groups. In situations where a difference in degree of shrinkage between groups of fibers can be achieved at a single spinning speed, a single laydown system may be employed as an alternative to a multiple laydown system, where the single laydown system employs a spin pack, as described above, that is configured to receive multiple molten polymer streams to extrude fibers with differing polymer components.

A desired difference in degree of shrinkage may also be achieved in the multiple laydown system 100 using the same polymer component or components for each group if one or more processing parameters are varied between the groups during fiber and/or web formation. For example, the first fiber group may be produced at a spinning speed that differs from the spinning speed of the second fiber group so as to achieve the desired differential in degree of shrinkage between the two groups. When using PET as the same polymer component for each group, the second fiber group 122 may be spun at a sufficiently low spinning speed below about 3500 MPM to ensure the fibers of this group are relatively amorphous upon being laid down on the screen belt 130, whereas the first fiber group 121 may be spun at a sufficiently high speed (e.g., above about 4000 MPM) to achieve a selected degree of crystallinity of the fibers in this group upon being laid down on the screen belt. In particular, spinning speeds in the range of about 5500 MPM for the first group of PET fibers and about 1500 for the second group of PET fibers have been determined to yield a suitable crystallinity differential, and thus a desired differential in degree of shrinkage, between the PET fiber groups to produce a nonwoven web with varying physical characteristics on opposing sides of the web.

A further example of achieving a desired difference in degree of shrinkage between first and second groups of fibers in a multiple laydown system involves processing steps applied to one group of fibers on the web forming surface to further crystallize this group in relation to the other group prior to forming a multilayered web from both groups. This may be realized, for example, when utilizing PET as the same single polymer component for first and second fiber groups, where both groups of fibers are produced in separate laydown fiber streams at spinning speeds below 3500 MPM such that the fibers of each group are relatively amorphous upon being laid down on the screen belt. A desired difference in degree of shrinkage can be achieved prior to combining the two fiber groups by simultaneously constraining and heating one of the two fiber groups on the screen belt such that these fibers achieve a desired degree of crystallization with limited or substantially no shrinkage. An exemplary method for providing combined constraint and heating of one of the groups of fibers on a web forming surface so as to crystallize while limiting shrinkage of the fibers is described in U.S. patent application Ser. No. 10/156,991. The disclosure of this patent application is incorporated herein by reference in its entirety.

After the first and second groups of fibers have been processed to achieve a desired difference in degree of shrinkage and have been combined on the screen belt 130, the multilayered web is directed past a compaction roll 142 to a nip formed by heated calender rolls 144 and 146 aligned in a vertically stacked relationship with each other. The calender rolls are heated to suitable temperatures to effect bonding of the fibers in the first and second groups together and to shrink fibers in the second group to a greater amount than fibers in the first group. Additional post-bonding heat treatment (not shown) may optionally be provided downstream from the calender rolls (e.g., by any one or combination of the previously described post-bonding heat sources) to ensure heat setting of the web and the desired shrinkage of fibers in the web. Alternatively, the degree of shrinkage of the fibers may be retained in the web and expressed in other processing systems by bonding the web utilizing minimal or substantially no heat (e.g., utilizing a needling or hydro-entangling process). The bonded web may then be collected on a winder roll or subjected to additional processing steps.

Figure 3A:
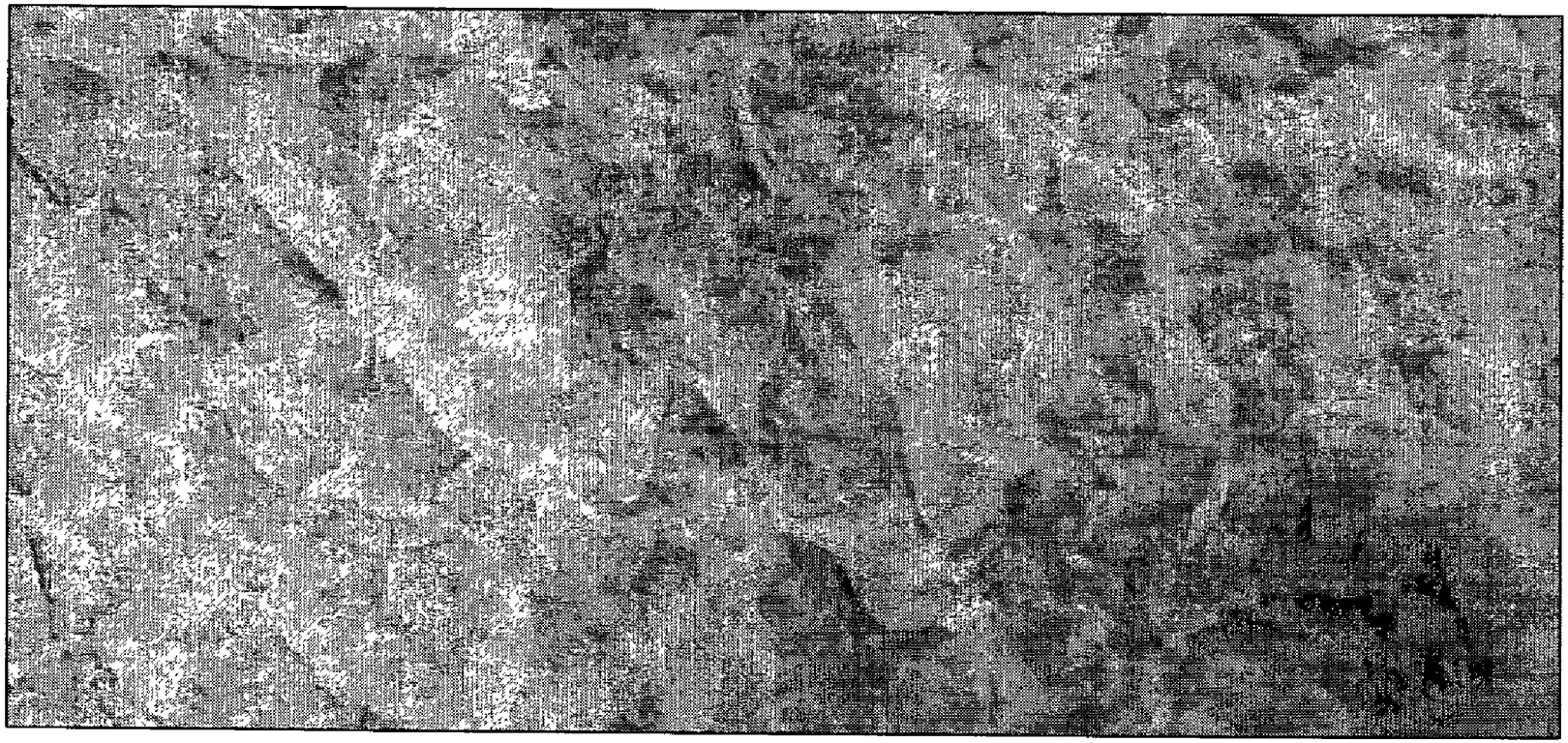
FIGS. 3*a* and 3*b* are photographic images of a nonwoven fabric product formed in accordance with the present invention.
Figure 3B:
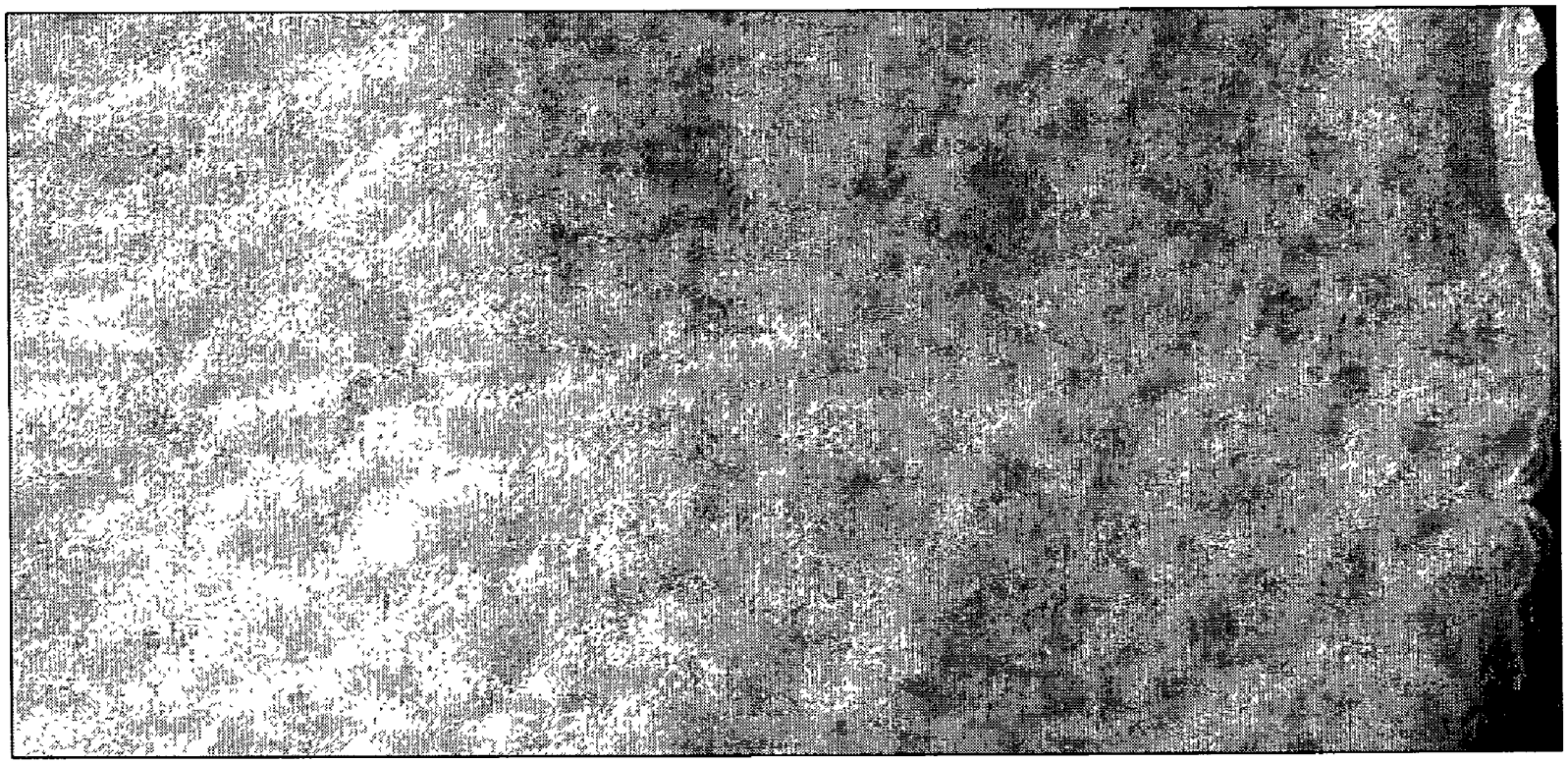

Photographic images of a nonwoven fabric product manufactured in accordance with the present invention are provided in FIGS. 3*a* and 3*b*. The fabric was manufactured utilizing a two laydown system substantially similar to the system of FIG. 2. However, it is noted that any of the previously described processes may be utilized to produce this fabric.

The fabric includes first and second groups of single component PET fibers, with the first group being produced at a spinning speed of about 5500 MPM and the second group produced at a spinning speed of about 1500 MPM. The first group of fibers forms a layer of the fabric depicted in FIG. 3*a*, while the second group forms an opposing layer of the fabric depicted in FIG. 3*b*. As is evident from the photographic images, the higher spun first group, which was crystallized to a much higher degree than the second group during fiber formation, becomes wrinkled to form a puckered layer as a result of the second fiber group shrinking during bonding and post-bonding heat treatment of the web. In contrast, the opposing layer formed by the second group remains relatively smooth and unwrinkled.

The puckering effect in fiber webs formed in accordance with the present invention can be enhanced by limiting bonding between the layers or groups of fibers having varying degrees of shrinkage. In addition, a gel or liquid layer (e.g., a moisture absorbent layer, medicament, etc.) may be added between layers of the web formed by groups of fibers with varying degrees of shrinkage. For example, in a two laydown system, the gel or liquid layer could be applied to a first group of fibers on the web forming surface prior to laydown of the second group of fibers onto the first group. The gel or liquid layer interferes with bonding between the two groups or layers of fibers and forms pockets of gel or liquid material within bonded web.

Fabrics produced in accordance with the present invention can be utilized in various useful products including, but not limited to, insulation fabrics, medical gauzes, and a variety of filtration products. In addition, a variety of additional products are possible with the addition of a gel or liquid layer to the web as described above.

The present invention is not limited to the particular systems and processes described above. The systems described above may be modified in any suitable manner to achieve a bonded web including at least two groups of fibers having a difference in degree of shrinkage that results in a realized shrinkage differential between fibers when the web is subjected to thermal bonding and/or post-bonding heat treatment. Further, the present invention may include single or multiple spunbond or meltblown systems or any suitable combinations of these two systems.

Any suitable heat source or combination of heat sources may be utilized to heat the bonded web of fibers to a selected temperature so as to heat set the web. For example, any combination of ovens, hot air knives, or other heating mediums (e.g., steam or other heated gases, infrared or X-ray radiation, etc.) may be utilized.

Any suitable constraining member may be utilized to limit or substantially prevent fiber shrinkage on the web forming surface and/or upon exiting the web bonder. In addition, bonding of the web may be achieved utilizing any suitable bonding process that employs any selected amount of heat to the web or is substantially heat free.

Having described preferred embodiments of new and improved systems and methods for producing nonwoven fibrous webs including fibers with varying degrees of shrinkage, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A spunbond nonwoven web comprising a first group of fibers bonded with a second group of fibers, wherein the first group consists essentially of first fibers and the second group consists essentially of second fibers, a degree of shrinkage associated with the second fibers is greater than a degree of shrinkage associated with the first fibers, the first fibers and second fibers are formed of the same polymer material, the same polymer material comprising polyester, and the first group of fibers forms a first surface of the web and the second group of fibers forms a second surface of the web that opposes the first surface such that the first surface of the web becomes wrinkled while the second surface is unwrinkled as a result of heat treatment to the web.

2. The spunbond nonwoven web of claim 1, further comprising an absorbent material dispersed within the web between the first and second groups of fibers.

3. The spunbond nonwoven web of claim 2, wherein the absorbent material comprises at least one of a gel material and a liquid material.

4. The spunbond nonwoven web of claim 1, wherein the same polymer material comprises polyethylene terephthalate.

5. A spunbond nonwoven web formed by bonding a first group of fibers with a second group of fibers and subjecting the bonded web to heat treatment, wherein the first group of fibers consists essentially of first fibers and forms a first surface of the web and the second group of fibers consists essentially of second fibers and forms a second surface of the web that opposes the first surface, the first fibers and second fibers are formed of the same polymer material, the same polymer material comprising polyester, and the second fibers of the second group have shrunk a greater amount than the first fibers of the first group as a result of the heat treatment such that the first surface of the web is wrinkled while the second surface is unwrinkled.

6. The spunbond nonwoven web of claim 5, wherein the same polymer material comprises polyethylene terephthalate.

7. The spunbond nonwoven web of claim 5, further comprising absorbent material dispersed within the web between the first and second groups of fibers.

8. The spunbond nonwoven web of claim 7, wherein the absorbent material comprises at least one of a gel material and a liquid material.

* * * * *